US005508487A

United States Patent [19]

Smith et al.

[11] Patent Number: 5,508,487

[45] Date of Patent: Apr. 16, 1996

[54] HIGH VOLTAGE CIRCUIT INTERRUPTING DEVICE OPERATING MECHANISM INCLUDING TRIP LATCH ASSEMBLY

[75] Inventors: David W. Smith, Pittsburgh; Jeffry R. Meyer, Greensburg, both of Pa.

[73] Assignee: ABB Power T&D Company Inc., Blue Bell, Pa.

[21] Appl. No.: 220,246

[22] Filed: Mar. 30, 1994

[51] Int. Cl.[6] ..... H01H 33/42; H01H 9/20

[52] U.S. Cl. ..... 218/154; 74/2; 200/400; 335/171

[58] Field of Search ..... 218/1, 7, 14, 46, 218/76, 78, 84, 92, 120, 140, 153, 154; 74/2; 200/400, 401, 318–327; 335/164–166, 171

[56] References Cited

U.S. PATENT DOCUMENTS

| | | | |
|---|---|---|---|
| 1,380,595 | 6/1921 | Ritz, Jr. | 200/429 |
| 1,820,928 | 9/1931 | Whitney et al. | 218/111 |
| 2,098,801 | 11/1937 | Erben | 218/5 |
| 2,375,416 | 5/1945 | Huber | 200/30 A |
| 2,995,043 | 8/1961 | Lusk et al. | 74/97.1 |
| 3,129,307 | 4/1964 | Munoz de Vargas | 218/1 |
| 3,141,936 | 7/1964 | Boyle et al. | 200/61.53 |
| 3,381,101 | 4/1968 | Strom et al. | 218/87 |
| 3,597,713 | 8/1971 | McClain et al. | 335/171 |
| 3,679,852 | 7/1972 | Himi et al. | 200/400 |
| 3,898,402 | 8/1975 | Ford | 200/409 |
| 4,162,385 | 7/1979 | Bould et al. | 200/400 |
| 4,594,488 | 6/1986 | Talpo | 218/46 |
| 4,713,508 | 12/1987 | Baginski et al. | 200/400 |
| 5,059,753 | 10/1991 | Hamm | 218/84 |
| 5,286,936 | 2/1994 | Hatekeyama | 200/400 |

*Primary Examiner*—J. R. Scott

*Attorney, Agent, or Firm*—Woodcock Washburn Kurtz Mackiewicz & Norris

[57] ABSTRACT

A circuit switching mechanism for use in a high voltage circuit breaker is disclosed. The disclosed mechanism comprises a charging system (12); trip latch mechanism (14); an opening spring (16); a closing spring (18) positioned coaxially with the opening spring; a support structure (22) supporting the open and closing springs; and a first rod member (24) operatively associated with a circuit interrupter, the first rod member being operatively coupled to the open and closing springs such that discharging of the opening spring effects the movement of the first rod member in a first direction and discharging of the closing spring effects the movement of the first rod member in a second direction. The trip latch mechanism (14) comprises a hammer; a trip link; a first pin through the hammer and trip link; a second pin attached to the trip link, the second pin positioned such that the hammer, upon a predetermined amount of rotation about the first pin, bears against the second pin; a trip finger; and a third pin through the trip link and trip finger, the trip finger bearing against the support structure to hold at least one of the springs in a charged state.

14 Claims, 11 Drawing Sheets

HIGH VOLTAGE CIRCUIT INTERRUPTING DEVICE OPERATING MECHANISM INCLUDING TRIP LATCH ASSEMBLY

CROSS REFERENCE TO RELATED APPLICATION

The subject matter disclosed in this specification is related to the subject matter disclosed in copending application Ser. No. 08/220,233, filed on Mar. 30, 1994.

FIELD OF THE INVENTION

The present invention relates generally to trip latch mechanisms and more particularly to a trip latch mechanism of the type used, for example, in a circuit switching device.

BACKGROUND OF THE INVENTION

One preferred application of the present invention is in circuit interrupting or breaking devices. As used herein, the expression "circuit breaker" encompasses any device which interrupts current in an electrical circuit. This expression is not intended to be limited to devices that perform additional functions, such as, for example, reclosing. The background of the invention is described below in connection with circuit breakers generally. However, it should be noted that, except where they are expressly so limited, the claims at the end of this specification are not intended to be limited to applications of the invention in a circuit breaker.

One use of a circuit breaker is in the distribution of three phase electrical energy. When a sensor or protective relay detects a fault or other system disturbance on the protected circuit, the circuit breaker operates to physically separate current-carrying contacts in each of the three phases by opening the circuit to prevent the continued flow of current. The major components of a circuit breaker include the interrupters, which function to open and close one or more sets of current carrying contacts housed therein; the circuit switching mechanism, which provides the energy necessary to open or close the contacts; the arcing control mechanism and interrupting media, which create an open condition in the protected circuit; one or more tanks for housing the interrupters; and the bushings, which carry the high voltage electrical energy from the protected circuit into and out of the tank(s). One preferred application of the present invention is in connection with a trip latch mechanism for a circuit switching device.

An example of a circuit breaker is depicted in FIG. 1. As shown, the circuit breaker assembly 1 includes three cylindrical metal tanks 3. The three cylindrical tanks 3 form a common tank assembly 4 which is preferably filled with an inert, electrically insulating gas (e.g., $SF_6$). The tank assembly 4 is referred to as a "dead tank" in that it is at ground potential. Each tank 3 houses an interrupter (not shown). The interrupters are provided with terminals connected to respective spaced bushing insulators. The bushing insulators are shown as bushing insulators 5*a* and 6*a* for the first phase; 5*b* and 6*b* for the second phase; and 5*c* and 6*c* for the third phase. Associated with each pole or phase is a current transformer 7. The circuit switching mechanism, or "operating mechanism," for opening and closing the interrupter contacts is contained within an operating mechanism housing 9. The operating mechanism is mechanically coupled to each of the interrupters via a linkage 8.

When used in connection with a switching mechanism, a trip latch holds the switching mechanism (that is, one or more springs of the switching mechanism) in a charged state until the potential energy stored by the switching mechanism is needed to open the protected circuit. Typical prior art trip latch mechanisms are required to withstand high impacts associated with open-close-open operations. Such prior art trip latches are necessarily sophisticated and expensive. A goal of the present invention is to provide a relatively simple, reliable, and inexpensive trip latch mechanism for circuit interrupting and other devices that are not required to perform open-close-open (i.e., reclosing) operations. A further goal of the present invention is to provide a trip latch mechanism which quickly removes itself from the path of moving parts propelled into motion upon release of the latch.

SUMMARY OF THE INVENTION

The present invention achieves the aforementioned goals by providing a trip latch mechanism comprising a hammer; a trip link; a first pin coupling the hammer and trip link, the hammer and trip link being rotatable about the first pin; a second pin attached to the trip link, the second pin positioned such that the hammer, upon a predetermined amount of rotation about the first pin, bears against the second pin; a trip finger; and a third pin coupling the trip link and trip finger, the trip finger being rotatable about the third pin. In a presently preferred embodiment, a tip portion of the trip finger has a rounded surface and an adjacent extended surface, the rounded and extended surfaces defining a corner for receiving a corner of a component to be latched. Preferred embodiments also include a return spring and a support member. The return spring is attached at a first end to the support member and at a second end to the hammer. In addition, the second pin comprises an eccentric member allowing the position at which the hammer bears against the second pin to be adjusted by rotation of the second pin.

In accordance with another aspect of the invention, a circuit switching mechanism for use in a high voltage circuit interrupting device comprises an opening spring; a closing spring positioned coaxially with the opening spring; a support structure supporting the open and closing springs; and a first rod member operatively associated with a circuit interrupter. Linear movement of the first rod member in a first direction effects the opening of an electrical circuit. The first rod member is operatively coupled to the opening and closing springs such that discharging of the opening spring effects the movement of the first rod member in the first direction. The opening spring is latched in a charged state by a trip latch mechanism in accordance with the present invention. Other features and advantages of the invention are described below.

BRIEF DESCRIPTION OF THE DRAWINGS

FIG. 2A depicts the system with opening and closing springs 16, 18 charged; FIG. 2B depicts the system with the closing spring discharged; and FIG. 2C depicts the system with the opening and closing springs discharged.

FIG. 4A shows the trip latch mechanism in the fully latched position; FIGS. 4B and 4C illustrate the trip latch mechanism in operation and in intermediate stages; and FIG. 4D shows the trip latch mechanism being fully released and the opening spring discharged.

DETAILED DESCRIPTION OF PREFERRED EMBODIMENTS

Figure 1:
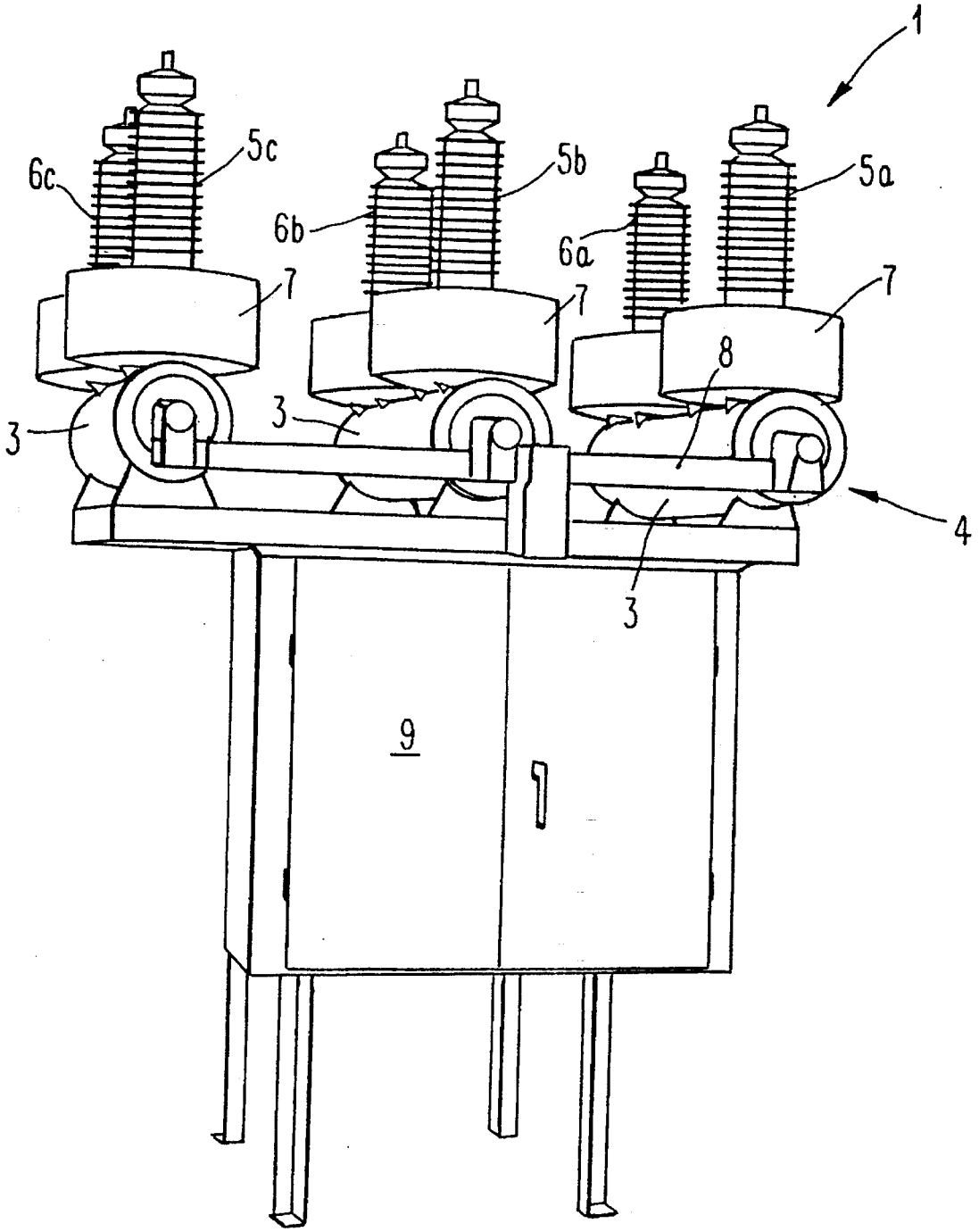
Fig. 1 (PRIOR ART)
FIG. 1 depicts a prior art multiple tank high voltage circuit breaker.
Figure 2A:
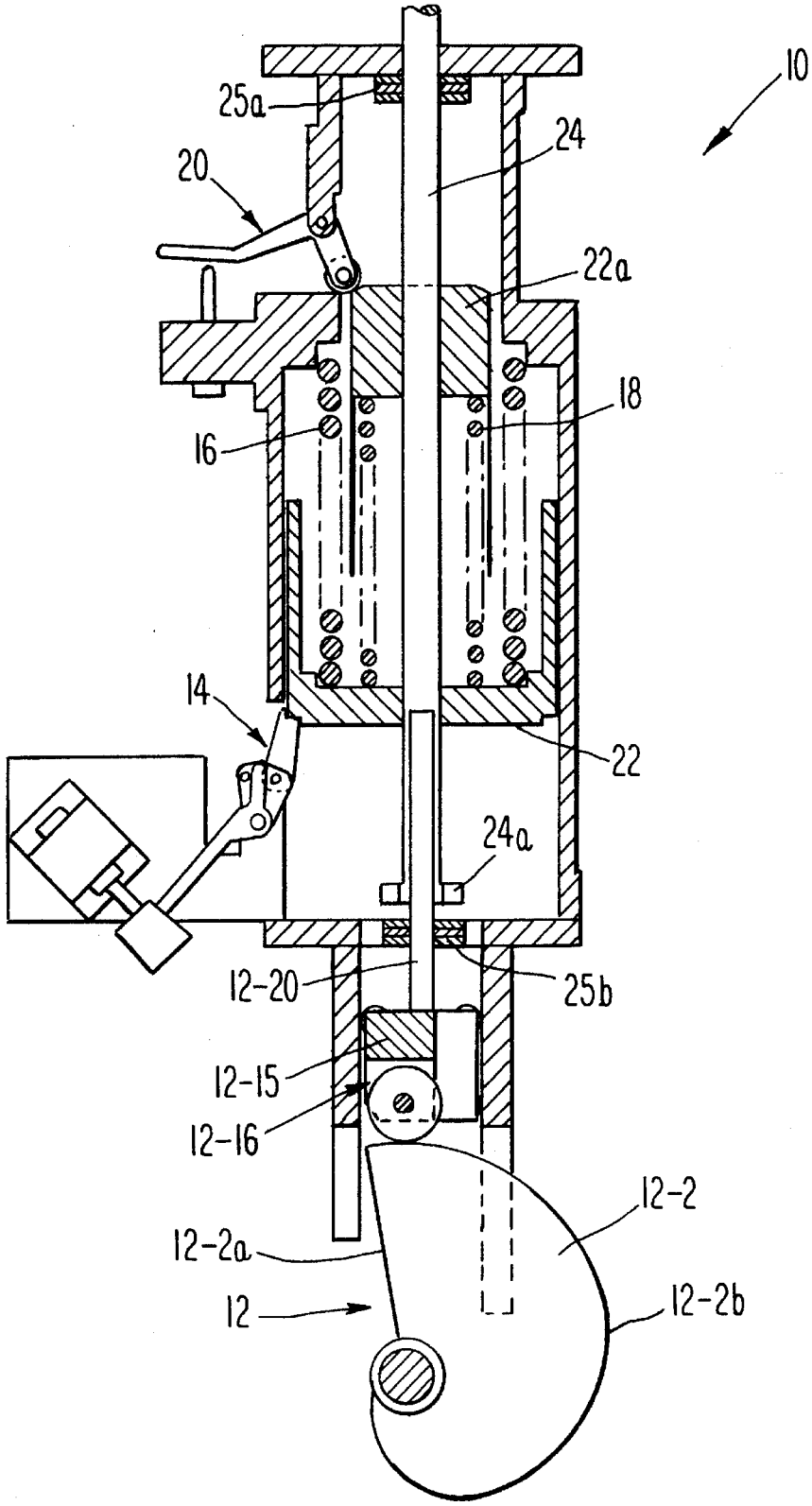
FIGS. 2A, 2B, and 2C depict side views of a circuit switching mechanism 10 comprising, among other things, a charging system 12 and a trip latch mechanism 14 in accordance with the present invention.
Figure 2B:
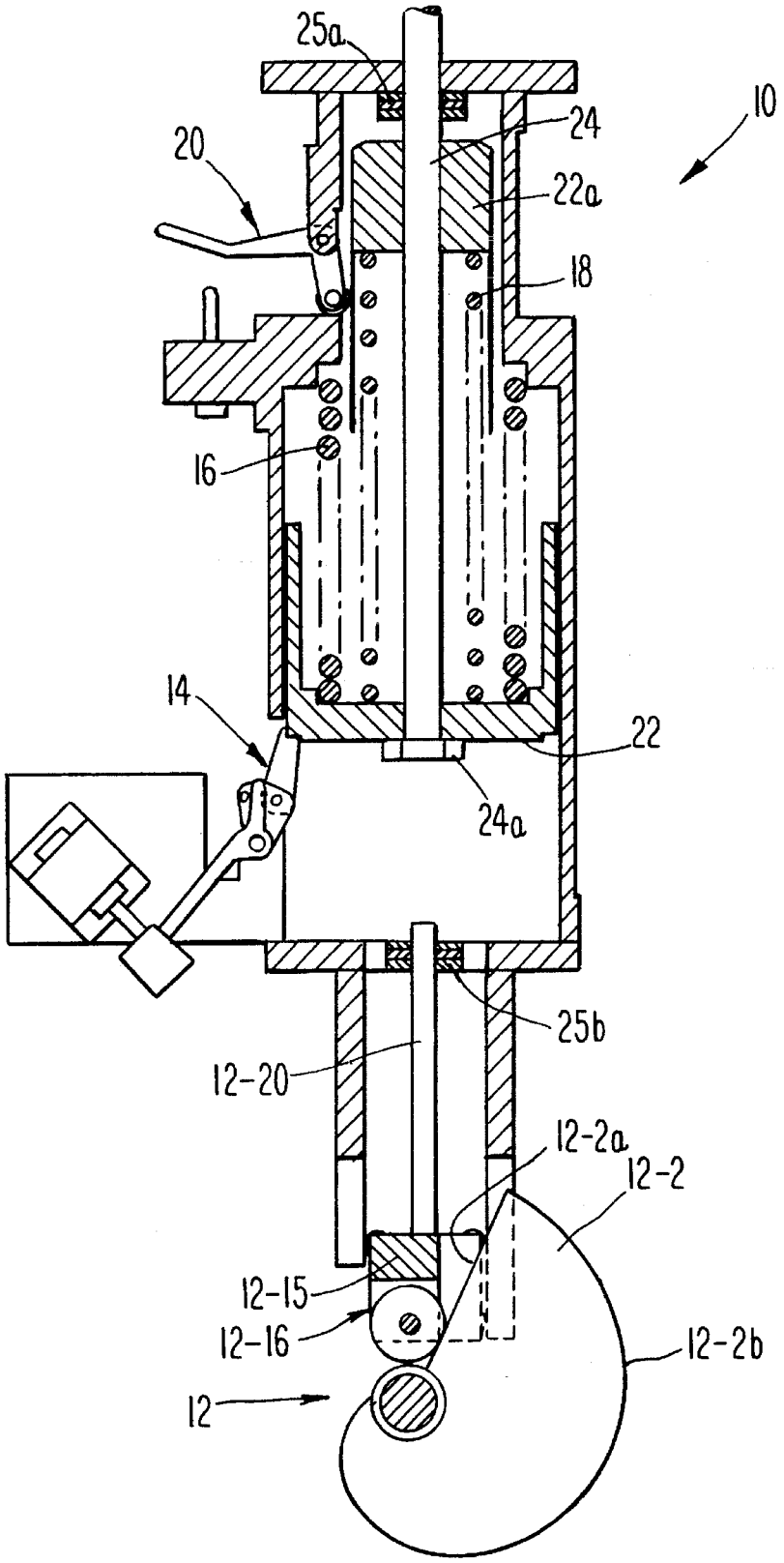
Figure 2C:
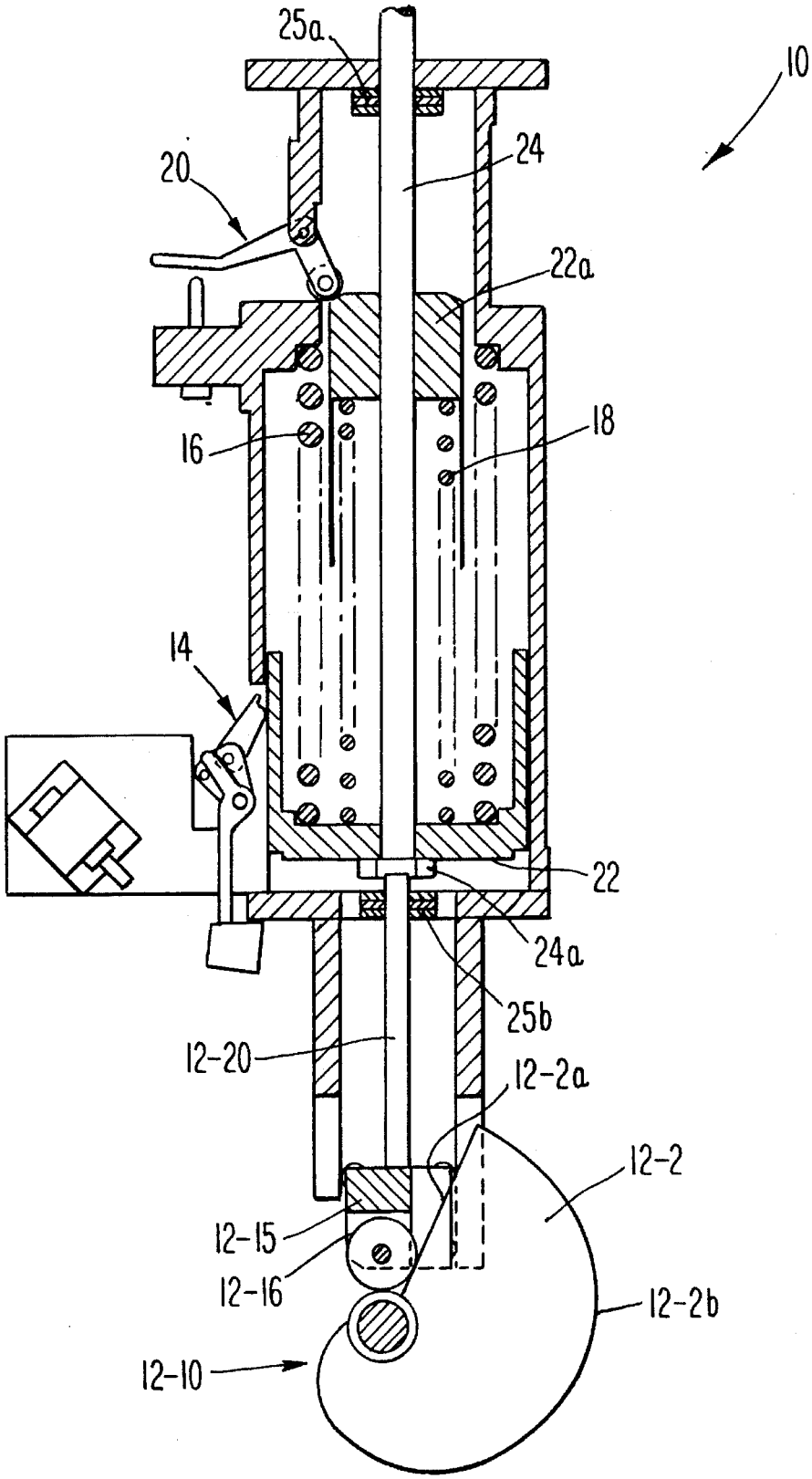

As mentioned, FIGS. 2A–2C depict a side view of a circuit switching mechanism 10 in accordance with the present invention. The circuit switching mechanism comprises a charging system 12; trip latch mechanism 14; an opening spring 16; a closing spring 18 positioned coaxially with the opening spring; a support structure 22 supporting the opening and closing springs; and a rod member 24 operatively associated with a moving contact of a circuit interrupter (not shown). As shown in FIG. 2A and 2B, the rod member 24 is "coupled" to the opening and closing springs 16, 18, in that the part of support member denoted 22*a* is attached (e.g., welded) to the rod 24 such that the closing spring 18 urges the rod upward. Similarly, when the support member 22 bears against the stop member 24*a*, as in FIG. 2B, the opening spring 16 urges the rod downward. With the trip latch assembly 14 in a latched state, unlatching the close latch assembly 20 discharges the closing spring 18 and permits the rod member 24 to move in an upward direction (FIG. 2B), thus closing the protected circuit. This closes the protected circuit (not shown) associated with the circuit breaker. Similarly, unlatching the trip latch assembly 14 discharges the opening spring 16 and effects the movement of the rod member 24 in a downward direction (FIG. 2C), which opens the protected circuit.

The circuit switching mechanism operates as follows: Assume the opening and closing springs 16, 18 are charged (compressed) and the trip and closing latches 14, 20 are latched as shown in FIG. 2A. FIG. 2A depicts the charging system 12 in the position it would assume just after charging the opening and closing springs by rotating the cam 12-2, with the protected circuit open as indicated by the lowered position of rod member 24. The cam 12-2 continues to rotate in a clockwise direction (looking into the plane of FIGS. 2A–2C) such that the cam roller follower 12-16 assumes a lowered position as shown in FIG. 2B. In this state, the push rod 12-20 is also in a lowered position. The closing spring 18 may then be discharged by releasing the close latch 20 as shown in FIG. 2B. This operation closes the protected circuit. Thereafter, when it is necessary to open the protected circuit, the trip latch 14 is released and the opening spring 16 discharges as shown in FIG. 2C. Note that the push rod 12-20 has already been cleared from the path of the support structure 22 to allow the tripping operation to occur, as necessary, immediately after the opening spring 16 has been charged. This quick opening capability is made possible by the steep drop of the cam's linear surface 12-2*a*. Immediately after the opening spring 16 discharges, the charging system 12 engages to recharge the opening and closing springs 16, 18. To recharge the opening and closing springs, the closing latch is operated to lock the rod 24 in the lowered position and prevent the protected circuit from being closed until the close latch is released. The cam 12-2 is then rotated in the clockwise direction to simultaneously recharge the opening and closing springs 16, 18. The trip latch may then be latched as shown in FIG. 2A. Thereafter, the close latch 20 may be released as in FIG. 2B to close the circuit.

The coaxial arrangement of the opening and closing springs 16, 18 provides a number of advantages. For example, presently preferred embodiments of the inventive mechanism provide linear motion with nearly one kilojoule of energy on the downward stroke and over one-half kilojoule of energy on the upward stroke. In addition, size is reduced by placing one spring inside another. This spring arrangement allows for an extremely compact spring design. The concentric spring arrangement also saves cost in material and machining. Moreover, this is an efficient mechanism since the springs 16, 18 directly move the operating rod 24. There is very little energy loss in the bearings, rotational shafts, and guides. Furthermore, the mechanism is inherently simple. Placing the rod 24 inside concentric springs provides a mechanism with very few parts and, consequently, high reliability. Cost is also reduced by having few parts.

In presently preferred embodiments of the charging system, bumpers 25*a*, 25*b* (FIGS. 2A–2C) comprise alternating layers of rubber and steel. These rubber and steel bumpers absorb energy by allowing the rubber layers to rub against the steel layers when compressed, and have proven to absorb more energy than rubber or steel alone. These bumpers are simple and protect the circuit interrupters from major failures due to over-travel.

The spring pack (parts 16, 18, 22) is allowed to rotate about the axis of the rod member 24 with the natural rotation of the springs. Both latches 14 and 20 will operate at any point on the circumference of the support structure 22. This reduces energy losses by reducing guide friction and allowing the springs to move freely. .

Figure 3A:
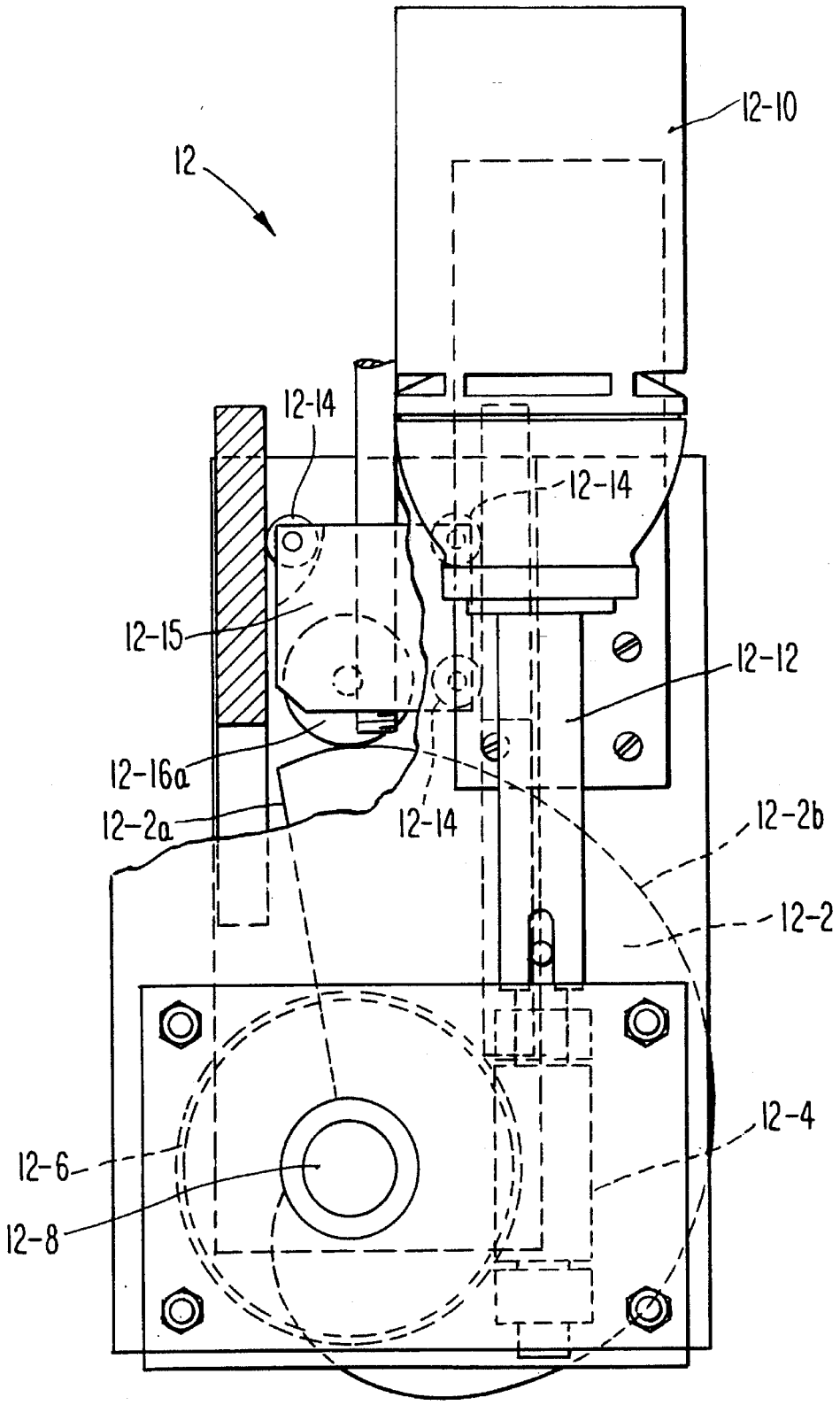
FIGS. 3A and 3B depict front and side views, respectively, of the charging system 12.
Figure 3B:
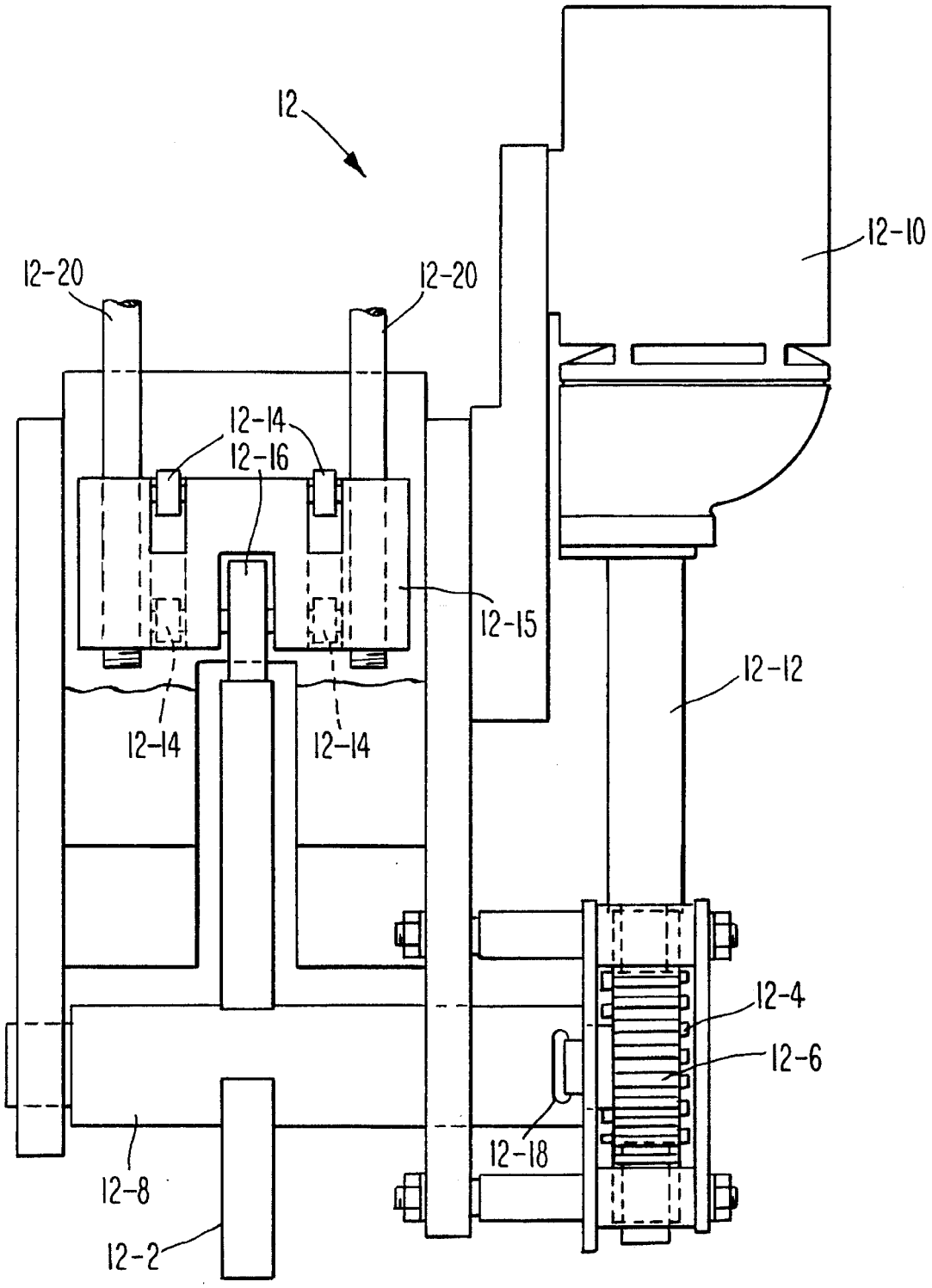

FIGS. 3A and 3B depict front and side views, respectively, of the charging system 12 for charging the open and closing springs 16, 18. As shown, the charging system comprises a cam 12-2 coupled via a worm gear, comprising a worm 12-4 and gear 12-6, and axle 12-8 to a motor 12-10. As shown, the cam includes a linear surface 12-2*a* and a curved surface 12-2*b*, with a sharp drop between the curved surface and the axle 12-8. Those skilled in the art will recognize that the worm gear transmits rotational energy from the motor to the cam. A rod 12-12 (FIG. 3B) couples the worm 12-4 to the motor 12-10. In addition, the charging system 12 includes a cam roller follower 12-16 comprising a number of smaller rollers 12-14 (held to a block 12-15 by roll pins) and a larger roller 12-16*a* bearing against the cam 12-2. The cam roller follower 12-15 moves linearly when the cam rotates. A connecting member 12-18 couples the axle 12-8 to the gear 12-6. Push rods 12-20 are coupled to the cam roller follower 12-16 and move linearly with the cam roller follower. The push rods 12-20 engage the support structure 22 as shown in FIGS. 2A–2C. In addition, in one presently preferred embodiment of the charging system, the cam 12-2 and axle 12-8 are cast as one piece.

The disclosed charging system 12 is especially suited for a linear motion mechanism. It is designed to rise slowly with significant force, then quickly lower itself out of the path of moving parts (e.g., the spring pack 16, 18, 22). The charging system, with its motor, worm gear, cam, and cam roller follower, is compact and cost effective. It also has other features. For example, the cam roller follower 12-16 is unique since it uses three, not four, roller bearing locations for stabilization. That is, the smaller rollers 12-14 are positioned on the vertices of a triangle, as shown in FIG. 3A.

The geometry of the guide "piston" (comprising six rollers 12-14, with two rollers at each of the three positions defining the triangle) is designed such that there will always be side load only on the three roller bearing locations. The guide piston will be stable for all loading from the cam 12-2. By only having three bearing locations, cost is saved in parts and the design is simplified.

In presently preferred embodiments, the guide for the cam roller follower 12-16 includes a center cut (recess) to allow the cam 12-2 to pass as depicted in FIG. 3B. The cam roller follower 12-16 falls out of the way of the spring pack (16, 18, 22) as it travels down the cam's linear surface 12-2*a*.

Figure 5:
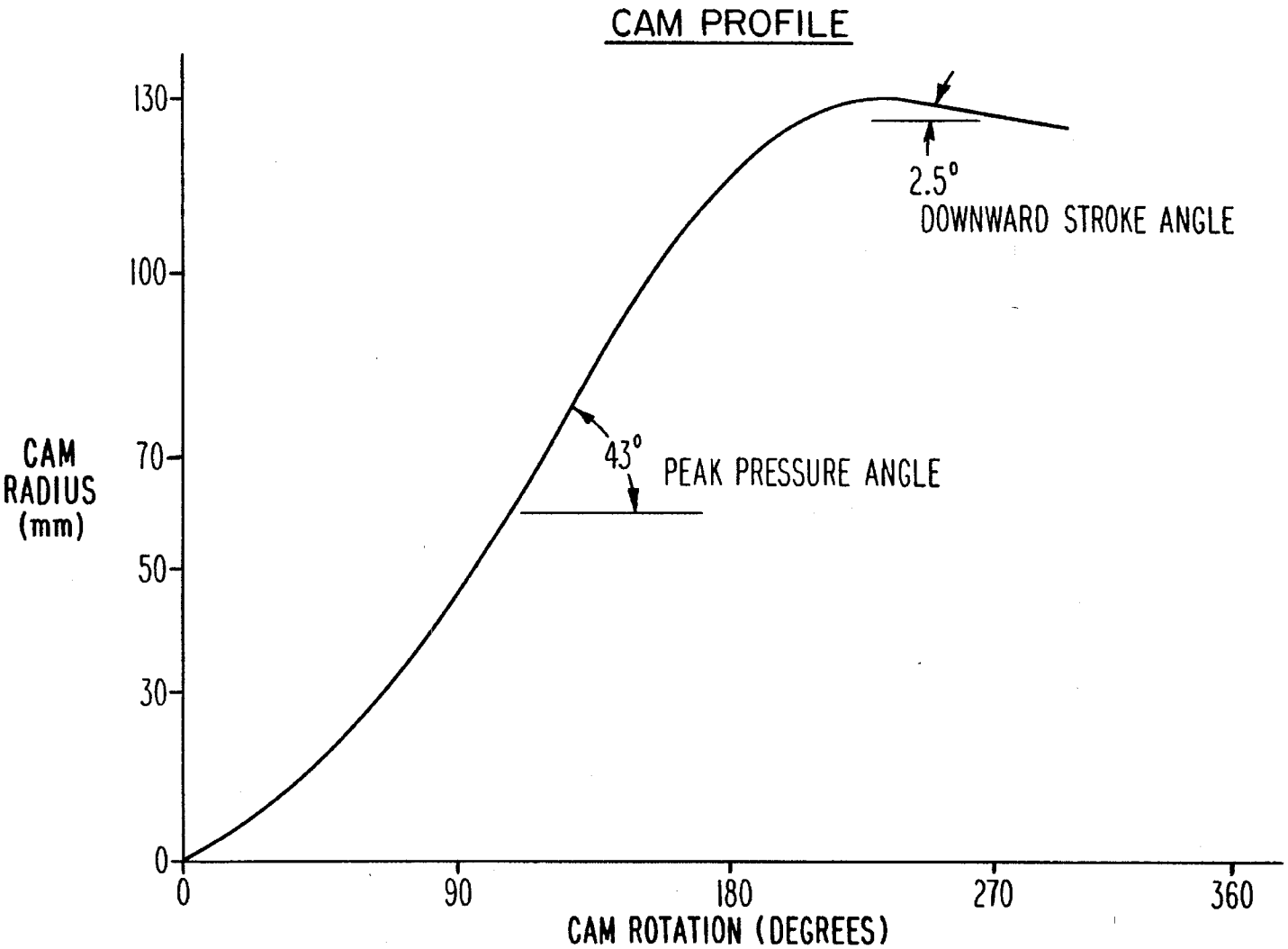
FIG. 5 is a graph of the cam profile, showing a peak pressure angle of 45 degrees and a downward stroke angle of 2.5 degrees.

In presently preferred embodiments, the cam 12-2 is designed with a peak pressure angle of 43 degrees. Those skilled in the art will recognize that the "pressure angle" defines the rate at which the radius of the cam increases along the cam's circumference. This is phenomenon graphically illustrated in FIG. 5, which is a graph of the cam profile showing the peak pressure angle and the 2.5 degree downward stroke angle. This is possible because these embodiments do not require a high speed cam and only need to pass a ten thousand operation life test, which is suitable use in a high voltage circuit switching mechanism. By using such a high pressure angle, the cam is significantly smaller than with more conventional cam designs. Furthermore, since it is not a high speed cam, it does not need the accuracy required for conventional cams. This saves material and machining costs. Moreover, the cam 12-2 minimizes impacts on the latches 14, 20 by moving the springs 16, 18 slowly up until the springs are just past the latch 14, then moving the springs slowly down until the latches are fully set. This latter feature is achieved by properly defining the cam's curvature.

Figure 4A:
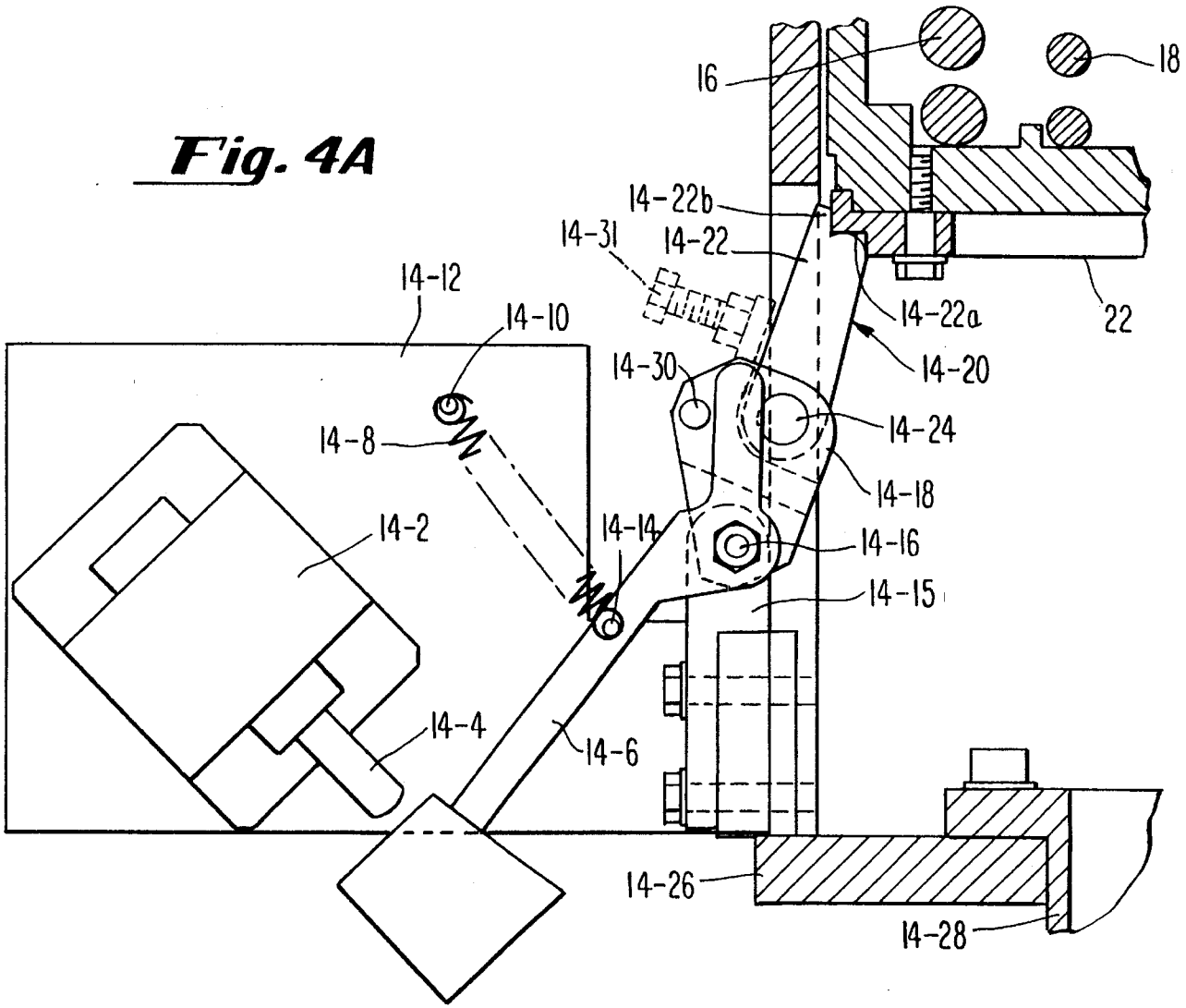
FIGS. 4A–4D depict the trip latch mechanism 14 in various stages of operation.
Figure 4B:
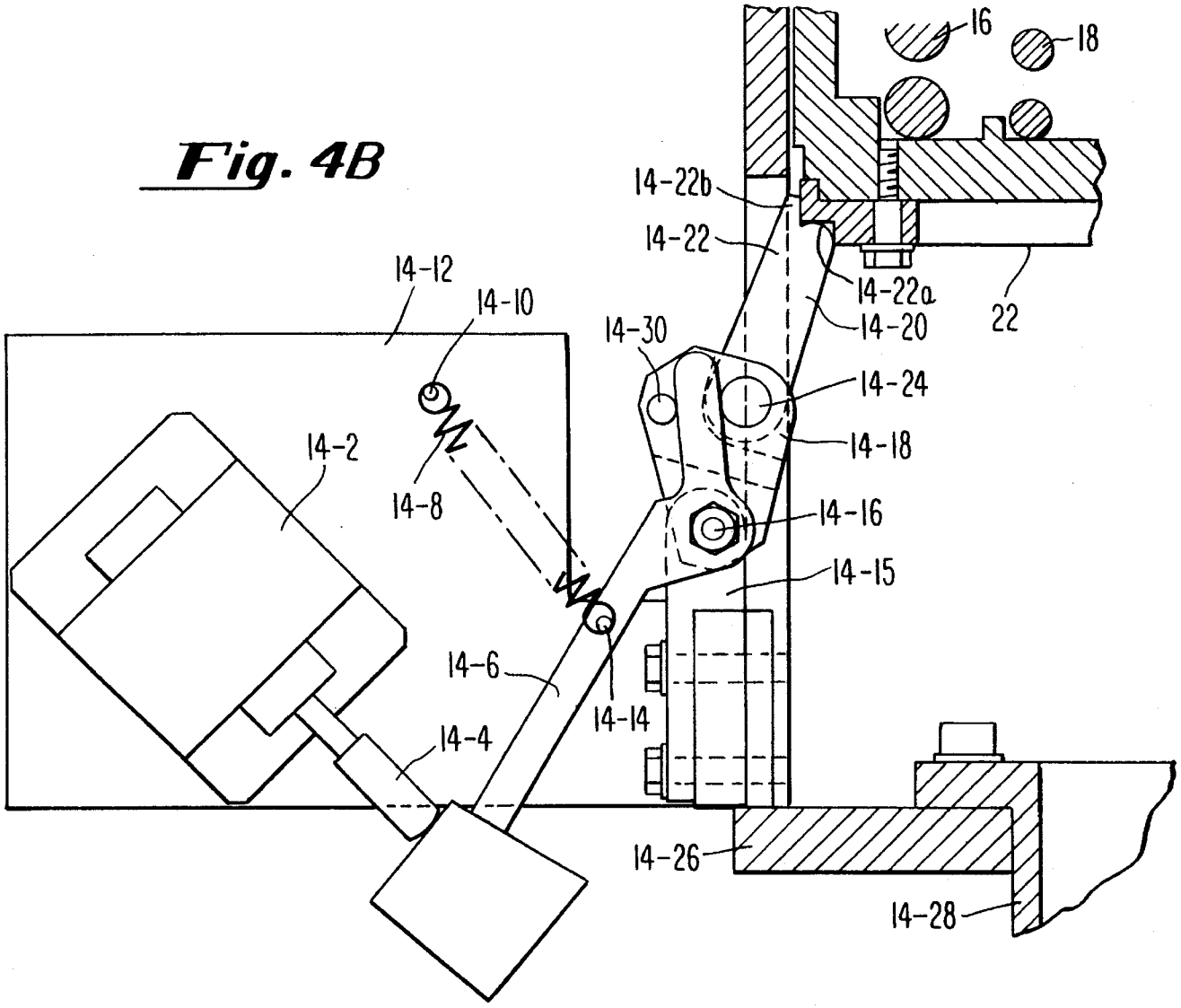
Figure 4C:
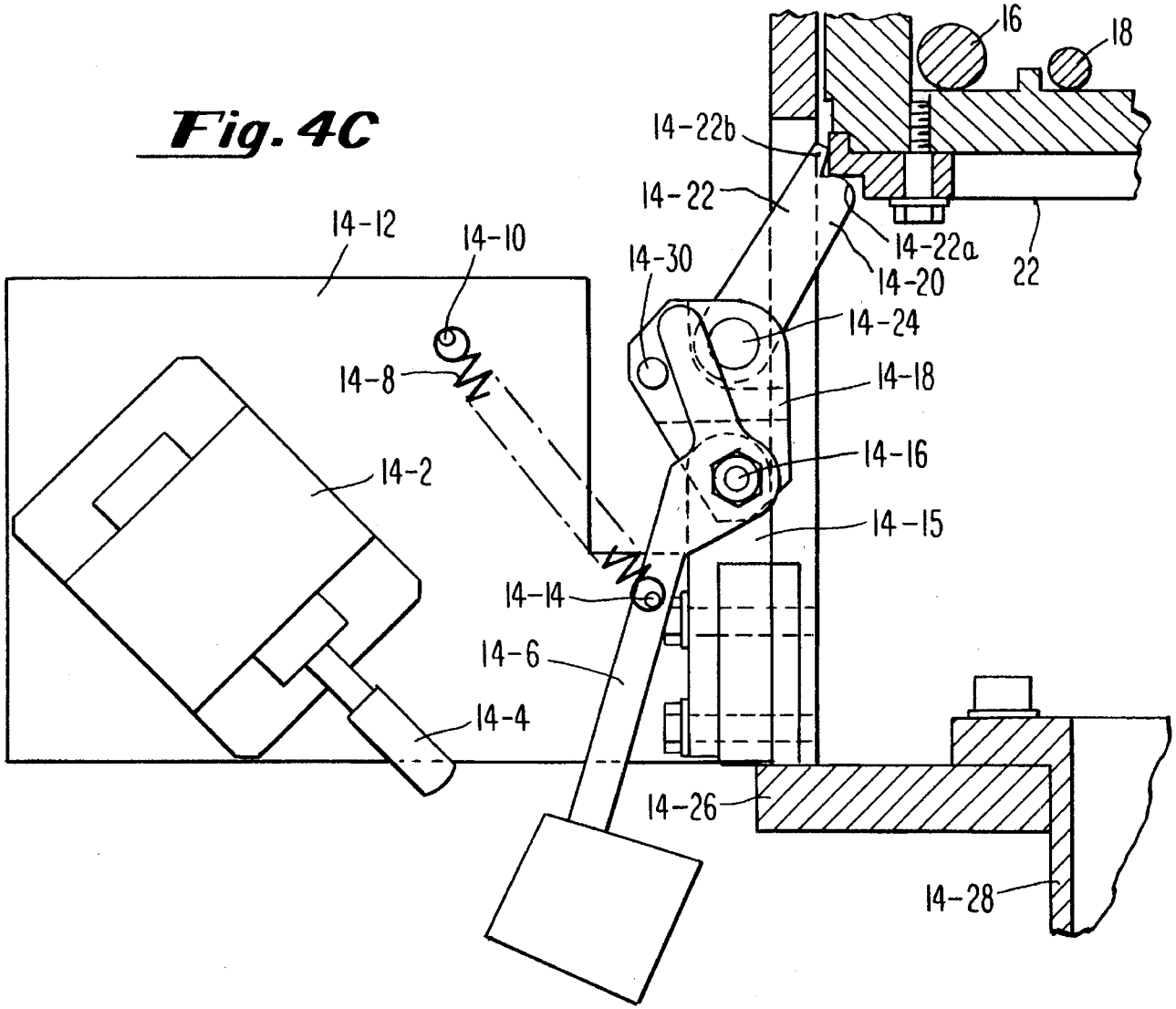
Figure 4D:
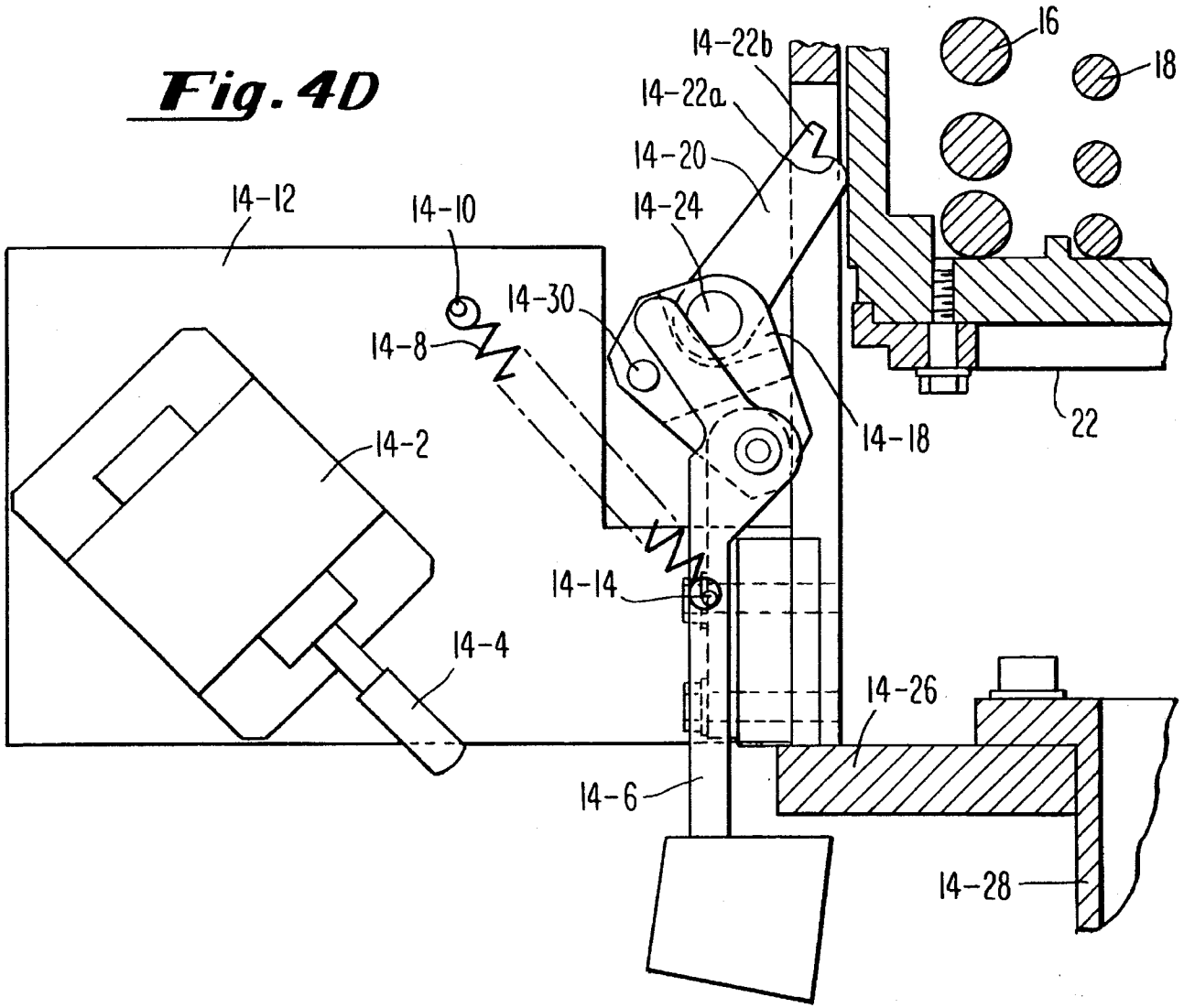

FIGS. 4A–4D depict the trip latch mechanism 14 in various stages of operation. The trip latch mechanism 14 comprises a solenoid 14-2 having a plunger 14-4; a hammer 14-6; a return spring 14-8 attached at a first end by a first pin 14-10 to a plate 14-12, and attached at a second end by a second pin 14-14 to the hammer 14-6; a support member 14-15; a pin 14-16 holding the hammer 14-6 to the support member 14-15 a trip link 14-18; a trip finger 14-20 bearing against the spring support structure 22, the trip finger including a tip portion 14-22 having a rounded surface 14-22*a* and an adjacent extended surface 14-22b, the rounded and extended surfaces defining a corner for receiving a corner of the support structure 22; a pin 14-24 coupling the trip finger 14-20 to the trip link 14-18; a flange 14-26; a bumper 14-28; and a pin 14-30. Pin 14-30 is positioned such that the hammer, upon a predetermined amount of rotation about the pin 14-16, bears against the pin 14-30. As depicted in FIGS. 4A–4D, the hammer 14-6 and trip link 14-18 rotate about pin 14-16. Similarly, the trip link 14-18 and trip finger 14-20 rotate about pin 14-24. It should also be noted that, at an appropriate point in its rotation, the extended surface 14-22*b* of the trip finger pushes the trip finger out of the path of the support structure 22. This allows the opening spring 16 to discharge (expand) as shown in FIGS. 2C and 4D.

The disclosed trip latch mechanism holds and allows easy release of the energy of a spring. The mechanism in which the spring is used can be a rotational or linear motion type of mechanism. Important features of the latch are the geometry of the trip finger 14-20, the hammer 14-6, and the pseudo two stage design. The expression "pseudo two stage" refers to the fact that a true two stage design employs two distinct levers (for increased mechanical advantage) whereas the disclosed trip latch employs a single "lever" comprising the hammer 14-6, trip link 14-18, and trip finger 14-20.

The geometry of the trip finger 14-20 allows the latch to move with very little friction over the toggle point. Then, after the mechanism starts to move, the trip latch moves out of the path of the moving spring pack. The hammer 14-6 is included to obtain the most force possible from the solenoid 14-2. When the hammer strikes the pin 14-30 in the trip link, the latch is moved with the kinetic energy of the hammer plus solenoid force. The solenoid moves the hammer through a relatively long initial stroke before striking the pin 14-30 attached to the trip link. This allows a low force solenoid to release a relatively large energy.

The pseudo two stage design of the trip latch requires less force to move the latch than a simple one stage solid finger design. The two main latch parts (trip link 14-18 and trip finger 14-20) act as moment arms to reduce the effective friction at the small diameter bearings. In presently preferred embodiments, the trip link comprises a bolt 14-31 to properly adjust the latch so the two main latch parts are just beyond the toggle position. That is, moving the bolt 14-31 in or out adjusts the point in the hammer's swing at which the it will move the trip link and trip finger away from the support member 22. This allows the latch to stably hold the load of the mechanism, and easily release the load when desired.

FIG. 4A shows the latch in the fully latched position. In FIG. 4B, the solenoid 14-2 has been activated, and the hammer 14-6 has struck the pin 14-30 in the trip link and moved the latch over the toggle point. In FIG. 4C, the motion of the mechanism has begun to move the trip finger 14-20 out of the path of the spring support structure 22. In FIG. 4D the latch is fully released and the opening spring is discharged.

Finally, while the invention has been described and illustrated with reference to presently preferred embodiments, those skilled in the art will recognize that modification and variations may be made without departing from the principles of the invention as described herein and set forth in the following claims. For example, the extended end of the trip finger 14-22*b* could be further extended to more effectively move the trip finger out of the path of moving parts. In addition, adding an adjustment screw or bolt to adjust the relative angle of the trip link and trip finger would allow the trip latch to be set as closely as possible to the toggle point, thereby allowing the latch to trip more effectively. Further, adding weight to the hammer or adding space between pins 14-24 and 14-30 would make the latch move more effectively. Moreover, the hammer may be decoupled from pin 14-24. Pin 14-24 is meant to be a return pin. When the latch is to be reset, spring 14-8 pulls back on the hammer 14-6, which in turn pushes on pin 14-24 to reset the latch. What may happen, however, is that the pin 14-24 pushes the hammer into plate 14-26, damaging the hammer. By decoupling the hammer from pin 14-24, this damage can be avoided. If this is done, another means for resetting the latch would be required. One solution would be to add a torsional spring around pin 14-16.

We claim:

1. A trip latch, comprising:

(a) a hammer (14-6);

(b) a trip link (14-18);

(c) a first pin (14-16) coupling said hammer and trip link, said hammer and trip link being rotatable about said first pin;

(d) a second pin (14-30) attached to said trip link, said second pin positioned such that said hammer, upon a predetermined amount of rotation about said first pin, bears against said second pin;

(e) a trip finger (14-20), said trip finger comprising a tip portion having a rounded surface (14-22*a*) and an adjacent extended surface (14-22*b*), said rounded and extended surfaces defining a corner; and (f) a third pin (14-24) coupling said trip link and trip finger, said trip finger being rotatable about said third pin.

2. A trip latch as recited in claim 1, further comprising means for effecting rotation of said hammer about said first pin.

3. A trip latch as recited in claim 1, further comprising means for effecting rotation of said hammer about said first pin.

4. A trip latch as recited in claim 1, further comprising a return spring (14-8) and a support member (14-12), said return spring being attached at a first end to said support member and at a second end to said hammer.

5. A trip latch as recited in claim 3, further comprising a return spring (14-8) and a support member (14-12), said return spring being attached at a first end to said support member and at a second end to said hammer.

6. A trip latch as recited in claim 1, wherein said second pin comprises an eccentric member, whereby the position at which said hammer bears against said second pin is adjustable by rotation of said second pin.

7. A trip latch as recited in claim 5, wherein said second pin comprises an eccentric member, whereby the position at which said hammer bears against said second pin is adjustable by rotation of said second pin.

8. A circuit switching mechanism for use in a high voltage circuit interrupting device, comprising:

(a) an opening spring (16);

(b) a closing spring (18) positioned within and coaxially with said opening spring;

(c) a support structure (22) supporting said open and closing springs;

(d) a first rod member (24) positioned within and coaxially with said opening and closing springs and operatively associated with a circuit interrupter, wherein linear movement of said first rod member in a first direction effects the opening of an electrical circuit and linear movement of said first rod member in a second direction effects the closing of the electrical circuit, said first rod member being operatively coupled to said open and closing springs such that discharging of said opening spring effects the movement of said first rod member in said first direction and discharging of said closing spring effects the movement of said first rod member in said second direction;

(e) a charging system (12) for charging said opening and closing springs; and (f) a trip latch mechanism (14), comprising a hammer; a trip link; a first pin coupling said hammer and trip link, said hammer and trip link being rotatable about said first pin; a second pin attached to said trip link, said second pin positioned such that said hammer, upon a predetermined amount of rotation about said first pin, bears against said second pin; a trip finger; and a third pin coupled said trip link and trip finger, said trip finger being rotatable about said third pin, said trip finger bearing against said support structure to hold at least one of said springs in a charge state.

9. A circuit switching mechanism as recited in claim 8, wherein said trip finger comprises a tip portion having a rounded surface and an adjacent extended surface, said rounded and extended surfaces defining a corner for receiving a corner of said support structure.

10. A circuit switching mechanism as recited in claim 8, further comprising a solenoid positioned to effect rotation of said hammer about said first pin.

11. A circuit switching mechanism as recited in claim 8, further comprising a return spring and a support member, said return spring being attached at a first end to said support member and at a second end to said hammer.

12. A circuit switching mechanism as recited in claim 8, wherein said second pin comprises an eccentric member, whereby the position at which said hammer bears against said second pin is adjustable by rotation of said second pin.

13. A circuit switching mechanism as recited in claim 9, further comprising a return spring and a support member, said return spring being attached at a first end to said support member and at a second end to said hammer.

14. A circuit switching mechanism as recited in claim 9, wherein said second pin comprises an eccentric member, whereby the position at which said hammer bears against said second pin is adjustable by rotation of said second pin.

* * * * *

UNITED STATES PATENT AND TRADEMARK OFFICE

CERTIFICATE OF CORRECTION

PATENT NO. : 5,508,487

DATED : April 16, 1996

INVENTOR(S) : David W. Smith; Jeffry R. Meyer

It is certified that error appears in the above-indentified patent and that said Letters Patent is hereby corrected as shown below:

Col. 4, line 50, "12-15" should be --12-16--

Col 5, line 17, "This is phenomenon" should read --This phenomenon is--

Col. 6, line 20, delete first occurrence of "the"

IN THE CLAIMS

Claim 8, (c), col. 7, line 35, delete "open" and substitute therefor --opening--.

Claim 8, (d), col. 7, last line, delete "open" and substitute therefor --opening--.

Signed and Sealed this

Twelfth Day of November, 1996

*Attest:*

Bruce Lehman

BRUCE LEHMAN

*Attesting Officer*

*Commissioner of Patents and Trademarks*